United States Patent [19]

Saiki et al.

[11] Patent Number: 4,709,911

[45] Date of Patent: Dec. 1, 1987

[54] AUTOMATIC SHEET FEEDING DEVICE

[75] Inventors: Eisaku Saiki, Yokohama; Masataka Kawauchi, Ishioka, both of Japan

[73] Assignee: Hitachi, Ltd., Tokyo, Japan

[21] Appl. No.: 22,958

[22] Filed: Mar. 6, 1987

Related U.S. Application Data

[63] Continuation of Ser. No. 578,110, Feb. 8, 1984, abandoned.

[30] Foreign Application Priority Data

Feb. 16, 1983 [JP] Japan ..... 58-22725

[51] Int. Cl.[4] ..... B65H 3/52

[52] U.S. Cl. ..... 271/10; 271/116; 271/122; 271/125

[58] Field of Search ..... 271/122, 125, 10, 114, 271/116, 109

[56] References Cited

U.S. PATENT DOCUMENTS

| | | | |
|---|---|---|---|
| 3,044,770 | 7/1962 | Breuers | 271/122 |
| 3,788,638 | 1/1974 | Lehmann | 271/109 |
| 3,976,291 | 8/1976 | Bernadi et al. | 271/122 |
| 4,346,880 | 8/1982 | Roller et al. | 271/122 |

FOREIGN PATENT DOCUMENTS 08038 7/1981 Japan .

*Primary Examiner*—Andres Kashnikow
*Assistant Examiner*—Matthew C. Graham
*Attorney, Agent, or Firm*—Antonelli, Terry & Wands

[57] ABSTRACT

An automatic sheet feeding device for feeding sheets of low rigidity and high coefficient of friction, such as documents of small thickness and thin sheets with carbon backing, including feeding rollers, separating rollers, a rotating mechanism for rotating the separating rollers, and a regulating mechanism for regulating a torque applied to the separating rollers. A torque tending to rotate the separating rollers in a direction in which the sheets are fed is applied thereto by the feeding rollers, and a torque tending to rotate the separating rollers in a direction opposite the direction in which the sheets are fed is applied thereto by the separating roller rotating mechanism through the regulating mechanism for regulating the torque applied to the separating rollers which is a friction clutch. By adjusting the torque transmitting force of the friction clutch, one of the two torques is selectively applied to the separating rollers depending on whether or not the sheets are held between the feeding rollers and separating rollers.

6 Claims, 8 Drawing Figures

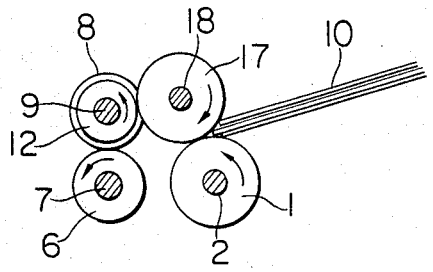
FIG. 5
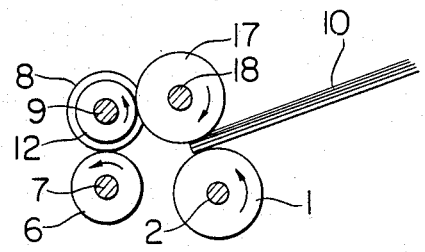
FIG. 6
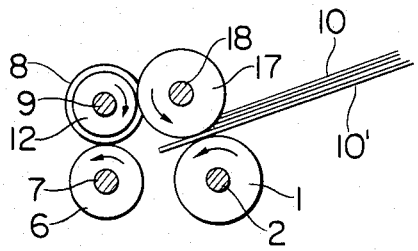
FIG. 7
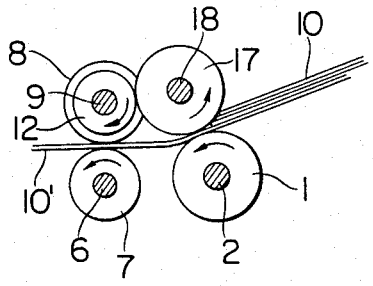

AUTOMATIC SHEET FEEDING DEVICE

This is a continuation of application Ser. No. 578,110, filed Feb. 8, 1984, now abandoned.

BACKGROUND OF THE INVENTION

1. Field of the Invention

This invention relates to automatic sheet feeding devices suitable for use with facsimile systems, optical read-out systems and other systems and apparatus that require automatic feeding of various types of sheets and notes, and more particularly it is concerned with an automatic sheet feeding device suitable for use in handling thin sheets, such as documents of small thickness or thin sheets with carbon backing, that have a high coefficient of friction.

2. Description of the Prior Art

In automatic sheet feeding devices for successively feeding one sheet after another from a stack of sheets by separating them to a desired operation station, each sheet is conveyed forwardly between feed rollers and respective friction members which are positioned against each other. When a plurality of sheets are delivered at a time to the feed rollers and friction members, they are separated from each other by the difference in the force of friction between the feed rollers, sheets and friction members. This sheet separation mechanism is simple in construction and used widely. However, this mechanism should be maintained with meticulous care so as to be in perfect operation condition at all times by keeping its components at a high degree of precision finishes, to enable the sheet feeding operation to be performed stably over a prolonged period of time without causing skewing of the sheets to occur.

A sheet feeding mechanism capable of performing sheet feeding stably over a prolonged period of time without the skew phenomenon is disclosed in Japanese Patent Laid-Open No. 88038/81, for example. In this sheet feeding mechanism, a stack of sheets set between the feed rollers and separation rollers are pushed back at the leading edge and reset following feeding of each sheet by the feed rollers from the stack of sheets, to thereby avoid skewing of the sheet fed by the feed rollers even if there is a sheet set in skew condition in the stack of sheets. Some difficulties would be experienced when this mechanism is used. Since the stack of sheets are pushed back between the feed rollers and separation rollers each time one sheet is fed by the feed rollers as aforesaid, misfeeding or feeding of a plurality of sheets might occur and the sheet fed might be wrinkled or deflected when the sheets handled are small in thickness, as is the case with documents of small thickness or thin sheets with carbon backing, because of their low rigidity. As a result, jaming of the sheets fed would occur. Particularly when the sheets handled are thin sheets with carbon backing, the carbon ink might adhere to surfaces of the rollers. When this phenomenon occurs, the force of friction exerted by the rollers would undergo changes and cause misfeeding or feeding of a plurality of sheets at a time to occur, and the carbon ink adhering to the surfaces of the rollers would stain the sheets fed by the feed rollers.

SUMMARY OF THE INVENTION

This invention has as one of its objects the provision of an automatic sheet feeding device of high reliability in performance capable of separating and feeding with high reliability those sheets which are high in the coefficient of friction, such as documents of small thickness or thin sheets with carbon backing.

Another object is to provide an automatic sheet feeding device of high reliability in performance capable of separating and feeding with high reliability those sheets which are high in the coefficient of friction and which tend to stain rollers and other parts, such as thin sheets with carbon backing.

According to the invention, there is provided an automatic sheet feeding device for successively feeding one sheet after another from a stack of sheets by separating them, comprising feeding means for feeding one sheet after another from the stack of sheets, separating means for separating the stack of sheets into individual sheets, torque regulating means for regulating a torque applied to the separating means, and rotating means for rotating the separating means through the torque regulating means, wherein the separating means is maintained in engagement with the rotating means and feeding means in such a manner that the separating means can be rotated freely in a direction in which the sheets are fed and in a direction opposite the direction in which the sheets are fed.

Also, in the automatic sheet feeding device of the aforesaid construction according to the invention, the separating means has a coefficient of friction with respect to the sheets which is selected to be lower than the coefficient of friction of the feeding means with respect to the sheets and higher than the coefficient of friction of one of the sheets with respect to another sheet.

BRIEF DESCRIPTION OF THE DRAWINGS

FIGS. 4–7 are views in explanation of the manner in which the sheets are separated and fed one sheet after another in the embodiment shown in FIGS. 1–3.

DESCRIPTION OF THE PREFERRED EMBODIMENT

Figure 1:
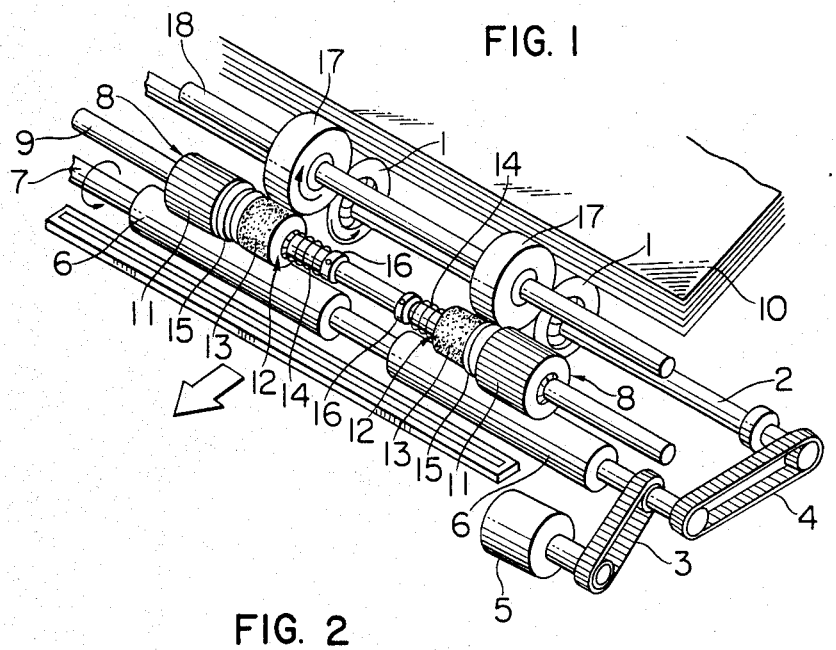
FIG. 1 is a perspective view of the automatic sheet feeding device in accordance with one embodiment of the invention.
Figure 2:
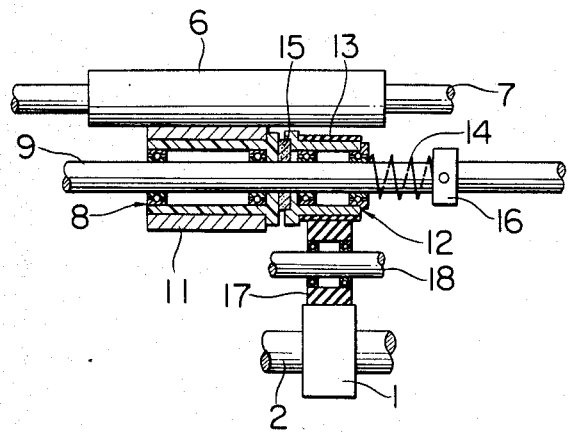
FIG. 2 is a fragmentary sectional view of the device shown in FIG. 1, showing in detail the essential portions thereof.

One embodiment of the automatic sheet feeding device in conformity with the invention will now be described by referring to the accompanying drawings. FIG. 1 is a perspective view, and FIG. 2 is a view shown on an enlarged scale of the essential portions of the device shown in FIG. 1.

Feeding rollers 1 formed of high friction material are supported by a shaft 2 which is driven through timing belts 3 and 4 by a motor 5. Conveying rollers 6 are supported by a shaft 7 which is driven through the timing belt 3 by the motor 5. Conveying rollers 8 in pressing engagement with the respective conveying rollers 6 are supported for rotation by a shaft 9. A friction member 11 of a coefficient of friction sufficiently high to hold a sheet 10, such as a document, between it and one of the conveying rollers 6 cooperating therewith to feed same to a destination is mounted on an outer circumferential surface of each of the conveying rollers 8. When the conveying rollers 6 are formed of rubber, the conveying rollers 8 are each formed integrally as a synthetic resinous material in the form of a cylinder and have grooves formed on an outer circumferential surface thereof. When the conveying rollers 8 of this construction are used, it is possible to convey the sheet 10 in a stable manner without using a friction member.

Rotating rollers 12 each have on an outer circumferential surface thereof a friction member 13 formed of any suitable rubber of a predetermined coefficient of friction and are supported for rotation by the shaft 9. Each of the rotating rollers 12 is forced at one end thereof through a friction member 15 against one end of each of the conveying rollers 8 by the biasing force of a spring 14. The biasing force of the spring 14 can be set at any value as desired by adjusting the position of a biasing force adjusting member 16 relative to the shaft 9.

Separating rollers 17 cooperating with the respective feeding rollers 1 to successively separate the sheets 10 one sheet after another are supported by a shaft 18. The separating rollers 17 are arranged to press against the respective feed rollers 1 and rotating rollers 12 by their own weight and receive torques by friction which are reversed in direction.

Figure 3:
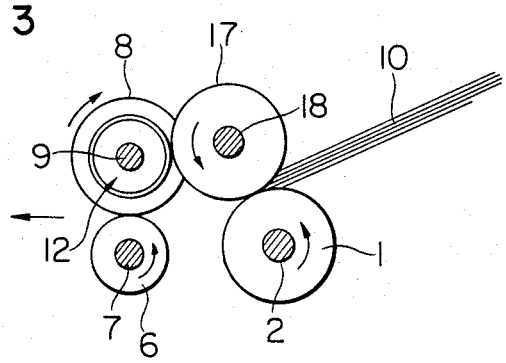
FIG. 3 is a sectional side view of the essential portions of the device shown in FIG. 2.

The operation of various rollers of the embodiment shown in FIGS. 1 and 2 will be described by referring to FIG. 3. Actuation of the motor 5 shown in FIG. 1 causes the feeding roller 1 and conveying roller 6 to rotate in a counterclockwise direction or in a sheet feeding direction as indicated by arrows. At this time, the feeding roller 1 formed of a high friction member causes a torque of clockwise direction to be applied to the separating roller 17.

Meanwhile, the rotation of the conveying roller 6 in the counterclockwise direction or the sheet feeding direction causes the feeding roller 8 in contact therewith to rotate in a clockwise direction. As a result, a force of friction which is determined by the friction member 15 and spring 14 in pressing engagement with the conveying roller 8 acts in such a manner that a torque of clockwise direction is applied to the rotating roller 12 by the friction member 15 and spring 14 which constitute cluth means.

The friction member 13 on the outer circumferential surface of the rotating roller 12 is formed of friction material of a coefficient of friction which is high enough not to produce slip between it and the separating roller 17.

Thus, the separating roller 17 receives from the feeding roller 1 a torque of clockwise direction, i.e., a direction opposite the sheet feeding direction and from the conveying roller 8 through the clutch means and the rotating roller 12 a torque of counterclockwise direction, i.e., a sheet feeding direction. At this time, the direction in which the separating roller 17 rotates is decided by the magnitudes of the torques applied thereto by the feeding roller 1 and conveying roller 8. By setting the torque transmitted through the clutch means at a lower magnitude than the torque produced by the feeding roller 1, the separating roller 17 is rotated by the feeding roller 1 in a clockwise direction when no sheet is held therebetween, to thereby cause the rotating roller 12 to rotate in a counterclockwise direction. At this time, adjustments are made through the clutch means to produce slip between the conveying roller 8 rotating in the clockwise direction and the rotating roller 12 rotating in the counterclockwise direction.

The operation of separating sheets one sheet from another and feeding same to a destination will be described by referring to FIGS. 4–7.

FIG. 4 shows the automatic sheet feeding device starting its operation after a stack of sheets 10, such as documents, are set in position in the device, as the motor 5 is actuated. At this time, the feeding roller 1 and separating roller 17 are in contact with each other as described hereinabove, so that the torque applied to the separating roller 17 by the feeding roller 1 is higher in magnitude than the torque transmitted from the conveying roller 8 through the clutch means to the separating roller 17. Thus, the separating roller 17 rotates in a clockwise direction.

As a result, as shown in FIG. 5, the stack of sheets 10 are bitten by the feeding roller 1 and separating roller 17 and start moving to the downstream side. As the stack of sheets 10 are held between the feeding roller 1 and separating roller 17, the torque from the feeding roller 1 is only transmitted to the lowermost sheet 10' of the stack of sheets 10 as shown in FIG. 6. The rotating roller 12, which has up to then been driven by the separating roller 17 to rotate in the counterclockwise direction, begins to rotate in a clockwise direction under the action of the clutch means and the conveying roller 8 in pressing engagement with the conveying roller 6 rotating in the counterclockwise direction, because transmission of the torque of higher magnitude from the feeding roller 1 to the separating roller 17 is interrupted. Thus, the rotating roller 12 rotates the separating roller 17 in a counterclockwise direction.

Thus, as shown in FIG. 7, the plurality of sheets 10 fed to the nip between the feeding roller 1 and separating roller 17 are successively moved rearwardly by the separating roller 17 rotating in the counterclockwise direction and only the lowermost sheet 10' is held between the feeding roller 1 and separating roller 17 and moved forwardly.

As described hereinabove, the coefficient of friction between the feeding roller 1 and separating roller 17 and the torque transmitted from the conveying roller 8 to the separating roller 17 through the clutch means are set such that the direction of rotation of the separating roller 17 is switched between the clockwise direction and counterclockwise direction by the presence or absence of the sheets 10 between the feeding roller 1 and separating roller 17. More specifically, the torque transmitted by the rotating roller 12 to the separating roller 17 and the torque transmitted by the sheets 10 to be fed by the feeding roller 1 to the separating roller 17 are set such that when the sheets 10 are held between the feeding roller 1 and separating roller 17, the former is higher in magnitude than the latter, and when no sheets 10 are held therebetween, the former is lower in magnitude than the latter.

In the aforesaid construction, the stack of sheets are first held between the feeding roller 1 and separating roller 17 after being bitten thereby and thereafter the sheets superposed one over another are moved rearwardly by the separating roller 17. Thus, even if the sheets handled are small thickness, it is possible to avoid jamming of the sheets which might otherwise occur when the leading edge of the sheets is folded.

A modification of the embodiment shown and described hereinabove will be described.

In the embodiment shown in FIGS. 1, although the feeding roller 1 and separating roller 17 can be rotated in the normal and reverse directions, they rotate as shown in FIGS. 6 and 7. Thus, when the sheets fed are those with carbon backing, the separating roller 17 would be stained by the carbon ink of the sheets with carbon backing as they are separated into individual sheets and the carbon backing is brought into direct contact with the separating roller 17 as shown in FIG. 6. This might cause a reduction in the coefficient of friction of the separating roller 17, resulting in sheet misfeeding, feeding of a plurality of sheets at a time or jamming of the sheets.

This trouble can be obviated by selecting a material of higher coefficient of friction than the sheets with carbon backing and lower coefficient of friction than the feeding roller 1, such as foamed urethane rubber, for forming the separating roller 17. By using such material for forming the separating roller 17, automatic sheet feeding of high reliability in performance can be achieved without the sheets being bent or broken or jamming of the sheets taking place.

Figure 8:
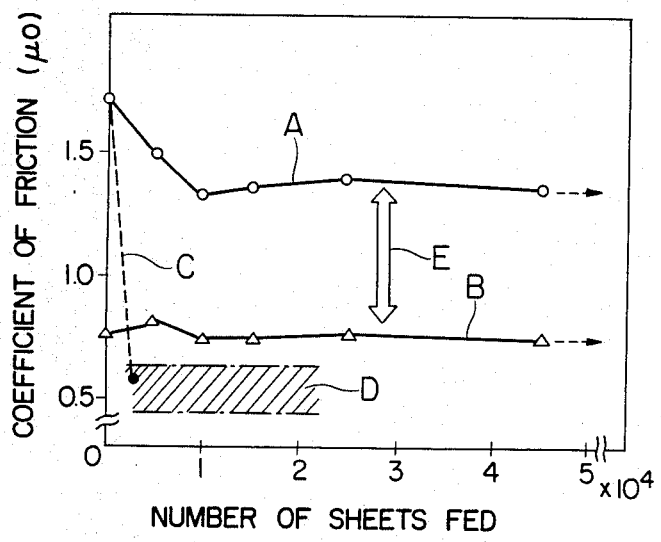
FIG. 8 is a diagrammatic representation of changes in the coefficient of friction in relation to the number of sheets fed, obtained when sheets with carbon backing are used as sheets handled by the device and materials for forming the separating rollers and feeding rollers are varied.

FIG. 8 is a diagram showing the results of experiments conducted by using foamed urethane rubber for forming the separating roller 17 and chloroprene rubber for forming the feeding roller 1 on changes in the coefficient of friction $\mu o$ in relative to variations in the number of sheets with carbon backing. In the diagram shown in FIG. 8, the abscissa represents the number of sheets fed by the feeding roller 1 and the ordinate indicates the coefficient of friction $\mu o$. In the figure, a line A with symbols ○, a line B with symbols Δ and a line C with symbols ● represent values as actually measured of the coefficient of friction of the feed roller 1, values as actually measured of the coefficient of friction of the separating roller 17 and values as actually measured of the separating roller formed of chloroprene rubber which is usually used for this purpose, respectively. A hatched region D indicates the range of the coefficients of friction of the sheets with carbon backing which are commercially available.

As can be seen in FIG. 8, the coefficient of friction of the feeding roller 1 is reduced in proportion to the number of sheets handled until the number of sheets reaches a level of about 10,000 and becomes substantially constant after such level is reached. Meanwhile, the separating roller 17 formed of foamed urethane rubber has substantially the same coefficient of friction after starting sheet feeding. The results of the experiments described have been obtained by setting the sheets with carbon backing in such a manner that the carbon backing of each sheet faces the separating roller 17.

From the results of the experiments shown hereinabove, it will be seen that when the separating roller 17 is formed of foamed urethane rubber, almost no change is caused to occur in the coefficient of friction of the peripheral surface of the separating roller by the separation and feeding of the sheets with carbon backing and the coefficient of friction of the separating roller 17 is kept at a level higher than that of the sheets with carbon backing at all times. This statement is supported by the results of the experiments obtained by feeding 45,000 sheets with carbon backing without any reduction in the performance of the automatic sheet feeding device.

However, it will be seen in FIG. 8 that when the separating roller 17 is formed of chloroprene rubber which is usually used for this purpose, the coefficient of friction of the separating roller 17 suddenly shows a reduction in the coefficient of friction, as indicated by the line C with the symbols ● with the carbon ink adhering to the peripheral surface of the roller after about 2,000 sheets have been handled. Thus, the coefficient of friction of the separating roller 17 is reduced to the range of the coefficients of friction of the commercially available carbon backed sheets designated by D. As a result, it has been impossible to feed the sheets with carbon backing in a stable manner without the occurrence of sheet misfeeding, feeding of a plurality of sheets at a time and skewing of the sheets. Thus, the use of the separating roller formed of chloroprene rubber has caused an increase in the incidence of sheet jamming.

In automatic sheet feeding devices of the prior art, it is because the feed roller and separating roller are formed of rubbers of substantially the same coefficient of friction that the rollers are markedly stained by the carbon ink. When the feeding roller and separating roller are substantially equal to each other in the coefficient of friction, the top surface and bottom surface of the sheets with carbon backing would be strongly rubbed by the respective rollers and the sheets might slide between the rollers. As a result, the roller coming first into contact with the carbon ink of the sheets would be rapidly stained and the stain would spread to the roller juxtaposed against the stained roller, thereby bringing the coefficients of friction of the two rollers closer to each other.

In the modification of the invention, the separating roller 17 is formed of foamed rubber of low coefficient of friction than chloroprene rubber for forming the feeding roller 1. Thus, even if the feeding roller 1 formed of chloroprene rubber shows a reduction in the coefficient of friction with time, a difference which remains substantially constant at all times can be produced in the coefficient of friction between the feeding roller 1 and separating roller 17 as indicated by an arrow E in FIG. 8, thereby enabling the sheets to be fed in a stable manner by the feeding roller 1. As a result, the occurrence of misfeeding and skewing of the sheets can be avoided, and the device which usually has a capacity of feeding only about 2,000 sheets can exhibit its initial performance even after feeding over 40,000 sheets, as indicated by the results of the experiments shown in FIG. 8.

When the separating roller 17 is formed of foamed urethane rubber, the relation between the feeding force and separating force exerted on the sheets 10 can be optimized. Thus, the risk of the carbon ink detaching itself from the sheets can be minimized and at the same time the risk of the surface of the separating roller 17 being stained by the carbon ink due to the action of miniscule pores formed on the surface of the roller can also be minimized.

Theoretical analysis of the mechanism whereby the phenomenon of carbon ink adhering to the surface of a roller formed of foamed rubber can be made difficult to occur has not yet achieved a success. However, it has been ascertained that staining of a roller formed of foamed rubber by carbon ink is overwhelmingly lower in incidence than staining of the surface of a roller formed of solid material. By inference, it is presumed that staining of the surface of a roller can be effectively prevented by forming small pores or grooves on the surface of the roller or knurling the surface of the roller or otherwise reducing the area of contact of the surface of the roller with a sheet, in addition to selecting foamed rubber as material for forming the roller.

In the embodiment shown and described hereinabove, the rotating roller 12 is provided at its outer circumferential surface with the friction member 13 to avoid the occurrence of slip between the separating roller 17 and rotating roller 12. Provision of the surface of the rotating roller 12 with small pores, grooves or projections while imparting to it a coefficient of friction high enough to avoid the occurrence of slip between it and the separating roller would have the effect of keeping the separating roller 17 and rotating roller 12 from being stained by the carbon ink of the sheets with carbon backing that are handled by the automatic sheet feeding device.

From the foregoing description, it will be appreciated that the automatic sheet feeding device according to the invention is capable of separating a stack of sheets into individual sheets and feeding one sheet after another to a destination with a high degree of reliability in performance even if the sheets handled have a high coefficient of friction and the risk of staining the roller by carbon ink, as is the case with sheets with carbon backing, and have hitherto been difficult to handle by an automatic sheet feeding device of the prior art. The invention has solved the problems raised in the prior art with regard to the staining of the rubber roller by carbon ink. More specifically, misfeeding of sheets, feeding of a plurality of sheets at a time and skewing of sheets can be avoided, thereby substantially eliminating the occurrence of jamming of sheets. Additionally, the invention has eliminated the need to use a carrier sheet that has hitherto been necessary. This is conducive to increased continuity of sheet feeding operation and does without maintenance since cleaning of the roller is hardly necessary to perform.

As described hereinabove, the automatic sheet feeding device according to the invention enables a stack of sheets of high coefficient of friction, such as documents of small thickness or thin sheets with carbon backing, to be separated into individual sheets and successively fed one sheet after another to a destination with high reliability in performance. The device also enables sheets, such as sheets with carbon backing, which tend to stain the rollers to be separated into individual sheets and successively fed one sheet after another to a destination with high reliability in performance without staining the rollers.

What is claimed is:

1. An automatic sheet feeding device for successively feeding sheets from a stack of sheets by separating the sheets, each sheet having a substrate and a material applied to a surface of the substrate so the material side of the sheet has a higher coefficient of friction than the substrate side of the sheet, the device comprising:

feeding means for feeding the sheets from said stack of sheets;

separating means cooperating with said feeding means for separating the sheets, such that said material side of the sheet to be fed tends to be separated from the substrate side of an adjacent sheet when a friction force acts on the material side of the sheet to be fed as a result of each sheet being in contact with said separating means during feeding, so as to allow the sheets to be fed one by one by said feeding means, a coefficient of friction of the separating means with respect to the sheets being lower than the coefficient of friction of the feeding means with respect to the sheets and higher than a coefficient of friction of one sheet with respect to another sheet;

torque regulating means for regulating a torque applied to said separating means;

rotating means for rotating the separating means through said torque regulating means; and wherein said separating means are maintained in engagement with the rotating means and feeding means in such a manner that the separating means can be rotated freely in a direction in which the sheets are fed and in a direction opposite to the direction in which the sheets are fed.

2. An automatic sheet feeding device as claimed in claim 1, wherein said feeding means for feeding the stack of sheets comprises feeding rollers, first conveying rollers and second conveying rollers, said separating means for separating one sheet from the stack of sheets comprises separating rollers, and said rotating means for rotating said separating means comprises rotating rollers.

3. An automatic sheet feeding device as claimed in claim 2, further comprising drive means for applying a torque to the feeding rollers and first conveying rollers to rotate same in the same direction, and wherein the feeding rollers are maintained in pressing engagement with the respective separating rollers to apply a torque to the separating rollers and the first rollers are positioned such that they apply a torque to the respective separating rollers through the rotating rollers, a slide clutch constituting said torque regulating means, and the second conveying rollers.

4. An automatic sheet feeding device as claimed in any one of claims 2 or 3, wherein said separating rollers are formed of foamed urethane rubber.

5. An automatic sheet feeding device as claimed in any one of claims 2 or 3, wherein said separating rollers are each on outer peripheries thereof with a surface which is shaped such that the area of contact with a sheet is reduced.

6. An automatic sheet feeding device as claimed in claim 1, wherein said feeding means has a surface thereof formed of chloroprene rubber, and said separating means has a surface thereof formed of formed urethane rubber.

* * * * *